United States Patent [19]

Popper et al.

[11] 3,945,324

[45] Mar. 23, 1976

[54] PROJECTILE FUSE

[75] Inventors: Jakhin Boas Popper, Kiryath Mozkin; Avigdor Lowy, Haifa, both of Israel

[73] Assignee: The State of Israel Ministry of Defence Hakirya, Tel Aviv, Israel

[22] Filed: Feb. 4, 1971

[21] Appl. No.: 112,701

[30] Foreign Application Priority Data

Feb. 12, 1970 Israel ..... 33890

[52] U.S. Cl. ..... 102/78; 102/70 R

[51] Int. Cl.[2] ..... F42C 1/04

[58] Field of Search ..... 102/7.2, 70, 76, 73, 78, 102/79

[56] References Cited

UNITED STATES PATENTS

| | | | |
|---|---|---|---|
| 1,344,558 | 6/1920 | Nieukirk | 102/7.4 |
| 1,418,606 | 6/1922 | Swan | 102/7.4 |
| 2,348,498 | 5/1944 | Robertson | 102/7.4 |
| 2,800,080 | 7/1957 | Jackson | 102/76 R X |
| 2,807,210 | 9/1957 | Wales, Jr. et al. | 102/78 X |
| 3,352,241 | 11/1967 | Combourieux | 102/76 R |

*Primary Examiner*—Verlin R. Pendegrass
*Assistant Examiner*—Harold Tudor
*Attorney, Agent, or Firm*—Kirschstein, Kirschstein, Ottinger & Frank

[57] ABSTRACT

A fuse assembly for use with projectiles such as shells, bombs, torpedoes and the like provided with an elongated extension rod which imparts to the fuse mechanical proximity characteristics and which is so dimensioned as to maintain optical ballistic characteristics.

6 Claims, 8 Drawing Figures

INVENTORS
JAKUIN BOAS POPPER
AVIGDOR LOWY

BY:
Kenbetter, Kenbetter, Offer & Frank

INVENTORS
JAKHIN BOAS POPPER
AVIGDOR LOWY
BY:
Cushman, Darby & Cushman, Myers & Frank

INVENTORS
JAKHIN BOAS POPPER
AVIGDOR LOWY

BY:
Kenbotan, Kenbotan, Offer & Jacob

INVENTORS
JAKHIN BOAS POPPER
AVIGDOR LOWY
BY:
Frankfurt, Kemlitzer, Olge & Frank

INVENTORS
JAKHIN BOAS POPPER
AVIGDOR LOWY

BY:
Kenbutzing Kenbutzing Off & Fank

PROJECTILE FUSE

This invention relates to projectiles such as shells, bombs, torpedoes and the like. The invention relates particularly but not exclusively to fin or spin stabilized projectiles such as mortar or artillery shells.

It has been increasingly realised that where the fragmentation effect of the projectile is of importance the fragment dispersion efficiency of the projectile is increased by having the projectile explode some distance from the target. In this connection reference can be made to FIG. 1 of the accompanying drawings which is a characteristic curve showing the variation of the area covered by fragments with height of explosion. It can be readily seen from this characteristic curve that this area rapidly approaches a maximum as the height of explosion increases from ground level to about a few meters and then gradually declines. Various methods have been proposed and, in some cases, adopted in order to achieve this objective of having the projectile explode some distance from the target. Thus the projectiles have been provided with electronically operated proximity fuses which are designed to be actuated when the projectile has arrived to within a certain minimum distance from the target. Such electronically operated proximity fuses are, however, very expensive and effective operation can be interfered with during flight by jamming and the possibility exists of exploding the projectile fitted with such a fuse in mid-flight. Furthermore, the fitting of a projectile with an electronically operated device opens up the possiblity of detecting the projectile in flight.

It has furthermore been proposed to provide aerial bombs with a so-called fuse extension consisting of a metal tube rigidly secured to the nose of the bomb and containing a bomb fuse. Whilst such a proposal is capable of limited application to aerial bombs in view of the practically minimal ballistic requirements of such bombs there has hitherto been no application of this proposal to fin or spin stabilized shells where the ballistic requirements are critical. This is in view of the fact that the addition of any element to such a shell seriously interferes with its ballistic characteristics. Furthermore the provision of such fuse extensions containing as they do explosive fuses is objectionable from a safety point of view and introduces difficulties in handling.

It is an object of the present invention to provide a projectile fuse assembly for a projectile designed to ensure the explosion of the projectile a predetermined distance from a target whilst at the same time maintaining optimal or adequate ballistic characteristics of the projectile.

According to the present invention there is provided a projectile fuse assembly comprising a fuse body and an enlongated extension rod adapted to extend therefrom and to be responsively coupled to a fuse detonating arrangement said rod being so dimensioned that the ratio $R_1/R_o$ as hereinafter defined is not less than unity.

DETAILED DESCRIPTION

Figure 2A:
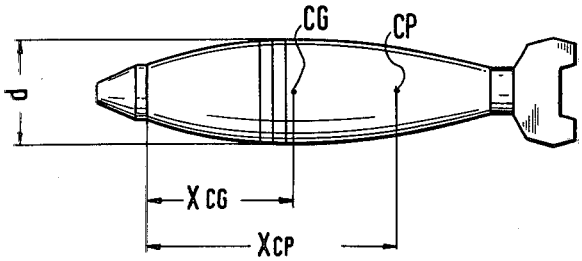
FIG. 2*a* is a side view of a fin stablized shell without an elongated forward extension rod.
Figure 2B:
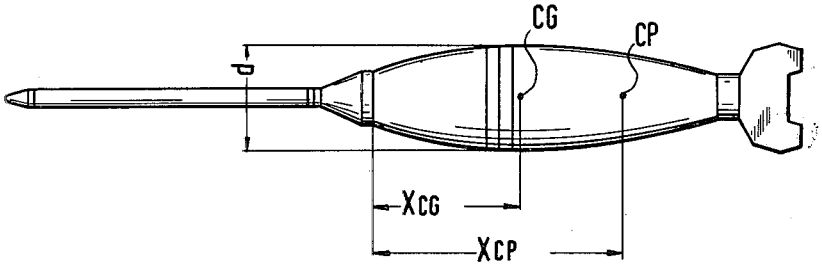
FIG. 2*b* is a side view of a fin stabilized shell with an elongated forward extension rod.

The present invention is based on considerations which are best understood by reference to FIGS. 2*a* and 2*b* of the drawings. The main parameters which govern the ballistic performance or stability of a shell are its moment of inertia I, its diameter d and the location of its centres of gravity and pressure CG and CP.

In FIG. 2*a* the distance of the centres of gravity and of pressure from a fixed reference position on the nose of the shell (not provided with an extension rod) are respectively $X_{CG}$ and $X_{CP}$ whilst the moment of inertia of such a shell is I. With the attachment of an extension rod to the shell as shown in FIG. 2*b* both the centres of gravity and pressure are moved towards the nose of the shell and the relevant distances are now $X_{1CG}$ and $X_{1CP}$ whilst the moment of inertia of the combined shell and extension rod is now $I_1$.

If now we define a stability factor R for the shell wherein $$R = \frac{X_{CP} - X_{CG}}{I}$$

then this factor will have a minimum value $$Ro = \frac{X_{CP} - X_{CG}}{I}_o$$

below which the shell will no longer be stable. Thus any variation of the various dimensional parameters of the shell must always be governed by the requirements that $$R >> Ro$$

and bearing in mind this requirement the three individual factors, $X_{CP}$, $X_{CG}$ and I can be separately varied.

If R >> Ro then the shell is overstable whilst if shell Ro then the sehll is close to the stability limit.

If now the stability factor for the shell to which the extension rod has been fitted is defined as $R_1$ then $$R_1 = \left| \frac{X_{CP} - X_{CG}}{I} \right|_1$$

and it can be shown that the addition of the extension rod does not deleteriously affect the ballistic performance of the shell if it is ensured that the ratio $R_1/R_o$ is not less than unity.

It can be readily seen from the relationship given above that the addition of the extension rod introduces several parameters into the stability factor which tend to act in opposite directions. Thus whilst on the one hand the stability factor tends to increase as a result of the displacement of the centre of gravity towards the nose of the projectile, on the other hand this stability factor decreases as a result of the similar displacement of the centre of pressure towards the nose. In particular the stability factor is deleteriously affected as a result of the increase of the moment of inertia $I_1$ of the projectile when fitted with the extension rod. It can be readily seen that an optimal set of dimensions for the extension rod can be arrived at for which the stability factor $R_1$ is at the worst not reduced and at best is increased.

In addition the extension rod must be sufficiently robust to withstand buckling thereof due to the considerable inertial forces acting thereon upon firing.

In the case of spin stabilized projectiles the extension rod and the projectile must be balanced so that the combined projectile-extension rod remain stable even at the highest rotational velocity.

In general, the provision of the projectile with the extension rod affects the drag of the projectile this drag increasing at subsonic speeds and decreasing at trans- and supersonic speeds leading at such speeds to an increased range.

Figure 1:
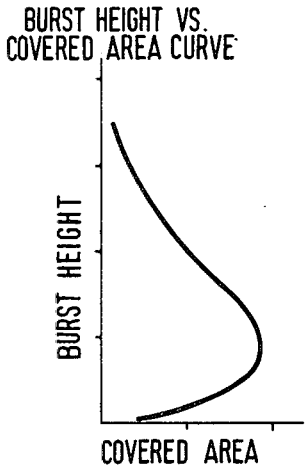
FIG. 1 is a graph of burst height versus area of fragment dispersion of a projectile.

Within the limitations defined above the extension rod can be made of any suitable length and in fact, as can be seen from FIG. 1, in order to achieve a high degree of fragment dispersion the extension rod should be relatively long. Practical considerations such as handling, packaging and logistical considerations in addition to the stability considerations referred to above limit the length of the rod and in practice the rod is generally not longer than the length of the projectile itself.

In accordance with a preferred embodiment of the present invention an end portion of this rod which can be releasably retained within the fuse body is floatingly retained in the fuse body so as to be capable of limited axial movement with respect to the body. With such an embodiment the merest contact of the tip of the extension rod with the target surface irrespective of the nature of that surface results in the immediate transmission of a shock wave through the floatingly held extension rod which is at once transmitted to a floating striker pin so as to strike a previously armed detonator. Thus, with such a floating arrangement, detonation is ensured at the instant of impact and the projectile equipped with such a floating extension rod can be used irrespective of the nature of the target, i.e. whether it is hard or soft.

In addition to its main function as a mechanical proximity fuse the extension rod can also serve as a grip or handle thereby facilitating easier handling of the projectile and easier extraction of a shell fitted therewith from a gun or mortar barrel seeing that the rod can be gripped by the extractor. In this way the use of an extractor having a shorter extractor handle is facilitated avoiding the necessity of providing the projectile itself with a special extraction groove.

Furthermore even when the shell is to be fired without an extension rod and has to be extracted from the barrel, an extension rod can be introduced into the extractor prior to lowering into the barrel which rod can be releasably secured to the fuse by being pushed down.

Figure 3:
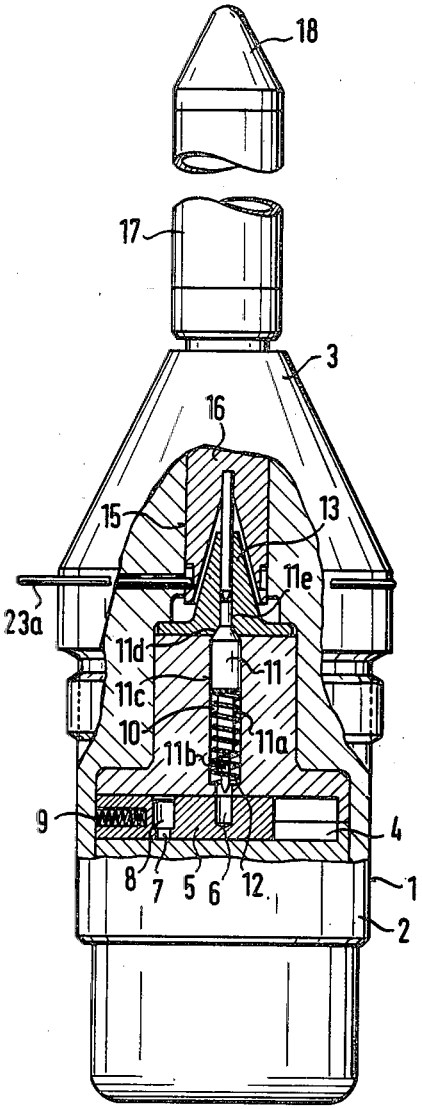
FIG. 3 is a partially sectioned side elevation of a shell fuse assembly in accordance with the present invention shown prior to firing.
Figure 4:
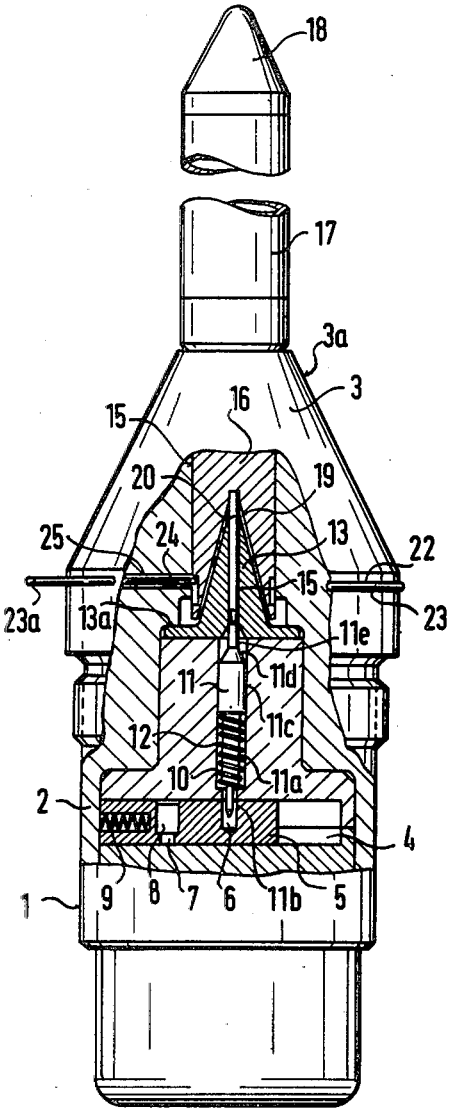
FIG. 4 shows the assembly, shown in FIG. 3 during firing and prior to arming.
Figure 5:
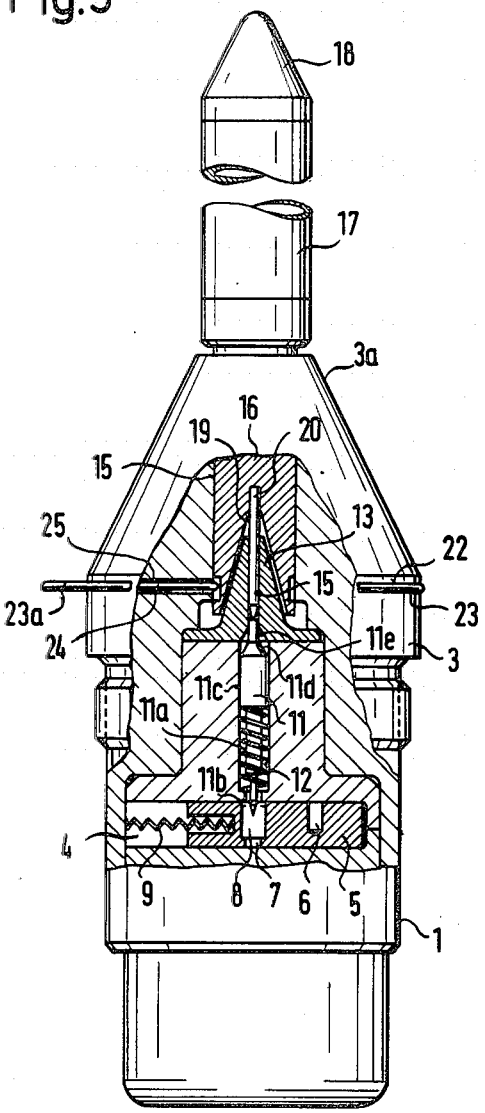
FIG. 5 shows the assembly shown in FIG. 3 after arming and at the instant of impact.

As seen in FIGS. 3, 4 and 5 of the drawings a shell fuse 1 comprises a two-piece fuse body 2, 3 the body portion 2 being fitted within and secured to the body portion 3 which has a tapering end portion 3*a*. In the body portion 2 there is formed a detonator cavity 4 which is located transversely of the longitudinal axis of the fuse 1. A detonator housing 5 is located in the detonator cavity 4 and is formed with a pair of cavities 6 and 7 so located that in the unarmed condition of the detonator the cavity 6 is aligned with a longitudinal axis of the fuse 1 whilst in the armed condition of the fuse the cavity 7 is aligned with a longitudinal axis of the fuse 1. The cavity 7 accommodates a detonator 8. A compression spring 9 is located in an end cavity of the detonator housing 5 and bears at one end on the detonator housing 5 and at the other end on the fuse body 2 and serves to bias the detonator housing 5 into an armed position. The means for arming the detonator is not of relevance to the present invention and is therefore not shown.

Slidable in an axial bore 10 formed in the housing portion 2 is an elongated striker 11 which consists of a main portion 11*a*, a pin portion 11*b* which is of smaller diameter than the main portion 11*a*, an intermediate portion 11*c* which is of greater diameter than the main portion 11*a*, and, which merges via a conical shoulder 11*d* with an end portion 11*e*. A compression spring 12 surrounds the pin portions 11*a* and 11*b* and bears at one end against a shoulder of the cavity 10 and at the other end against a shoulder formed between the pin portions 11*a* and 11*c*. As can be seen the tip of the striker pin 11*b* projects towards the detonator housing 5 but is biased away therefrom by the compression spring 12. The striker 11 is capable of limited axial movement in the bore 10 between one position shown in FIG. 3 of the drawings where the conical portion 11*d* thereof bears against a corresponding conically flared mouth of an axial bore formed in a conical end piece 13 and a position wherein the tip of the striker pin projects into one or other of the cavities 6, 7 formed in the detonator housing 5.

The axially bored conical end piece 13 is held in position be means of a flanged rim 13*a* between juxtaposed shoulders of the body portions 2 and 3.

The conical end portion 3*a* of the body portion 3 has formed therein an axial bore 15 in which is slidably fitted a solid end portion 16 of a tubular extension rod 17 formed with an end spike 18. The free end of the solid end portion 16 is formed with a conical axial recess 19 in which is accommodated the conical end piece 13. Secured to the end portion 16 and extending through the conical recess 19 is a transmission pin 20 which extends into the axial bore formed in the conical end piece 13.

A circumferential groove 22 is formed in the solid end portion 16 near the free end thereof. A spring ring 23 surrounds the outer wall of the body portion 3 one end of this ring (not shown) being anchored to the body portion 3 and the other end 24 being bent round so as to project somewhat away from the body portion 3 and is then passed through a transversely directed aperture 25 formed in the body portion so that its tip is located in the circumferential groove 22. In this way the solid portion 16 of the extension rod 17 is retained within the fuse body but is axially displaceable therein within limits defined by the width of the groove 22. On the other hand, the rod 17 can be rapidly and easily removed from the fuse body by pulling the projecting portion 23*a* of the ring out of the fuse body thereby releasing the rod for withdrawal.

In the embodiment shown the transmission pin 20 abuts the end of the striker 11 and the compression spring 12 biases the rod 17 away from the fuse body.

Prior to firing the fuse assembly is in the position of FIG. 3 of the drawing. Upon firing but prior to arming of the fusing the extension rod 17, which is effectively floating with respect to the fuse body, is subject to set back forces and is displaced inwardly with respect to the body and the position thereupon adopted by the extension rod 17 and striker 11 is shown in FIG. 4 of the drawings. During flight inertial and aerodynamic forces appear and the compression spring 12 has to overcome the difference between the aerodynamic forces which push the rod into the fuse and the inertial forces which tend to pull the rod out of the fuse. The fuse becomes armed, i.e. the detonator 8 moves under the influence of spring 9 into an axial position directly opposite the striker 11.

Upon the instance of impact of the spike 18 of the extension rod 17 on the target surface a shock wave is transmitted along the length of the rod 17 and this shock wave is transmitted from the transmission pin 20 to the striker 11 and causes the striker 11 to move forward against the spring biasing force into the cavity 7 and thereby to detonate the detonator 8. It will be realised that this movement of the striker 11 takes place as a result of the transfer of momentum from the floating extension rod 17 to the floating striker 11 and is not directly dependent on the displacement of the extension rod 17 into the fuse body although this displacement does take place. In consequence the transfer of momentum which leads to the displacement of striker 11 is effectively independent of the nature of the target and the contact of the spike 18 with any target such as, for example, soft sand or even water is sufficient to cause this displacement. In this way it can be ensured that the fuse is effectively detonated and the shell explodes at the precise height required which is in fact determined by the length of the extension rod 17. The length of the rod 17 is determined by considerations outlined above. In practice if the spike hits a penetrable target such as soft sand the degree to which the spike penetrates the target depends essentially on the very small distance which the striker has to travel before it strikes the detonator and in practice the degree of penetration is small if not negligible.

It is to be noted that the fuse shown in FIGS. 3 to 5 of the drawings can be provided with a conventional delay mechanism so that when not provided with the extension rod the fuse operates in a normal manner with a predetermined delay. Furthermore the provision of this conventional delay mechanism ensures the explosion of the shell even if the proximity fuse fails to operate.

The provision of the axially bored conical piece 13 is for the situation when the fuse is not fitted with the extension rod and is intended to be operated with a conventional delay mechanism. Under these circumstances the entry of soil, dirt, etc. into the open end of the fuse body merely blocks the narrow mouth of the axial bore of the end piece but cannot actuate the firing pin 11 before the operation of the conventional delay mechanism.

As indicated above the rod must be capable of resisting plastic buckling whilst under certain circumstances elastic buckling might be permitted. For this purpose the rod which can be tubular or solid can, for example, be made of steel or aluminium. In a characteristic example an extension rod formed of aluminium tubing of 20 mm diameter and 430 mm length and weighing 180 g was successfully employed with fuses designed for use with the following projectiles.

i. A 120 mm fin stabilized mortar shell weighing 14 kg and having an overall length of 508 mm,
ii. A 160 mm fin stabilized mortar shell weighing 41.5 kg and having an overall length of 797 mm, and
iii. A 155 $mm_{sp}$ in stabilized artillery shell weighing 43 kg and having an overall length of 716 mm.

In all cases the extension rod dimensions were such that the ballistic characteristics of the shell to which it was fitted were not impaired and, in fact, a tendency could be detected that the stability of the projectile was increased and dispersion with respect to the target as a consequence reduced. Furthermore, the provision of the extension rod decreased the drag of the projectile at transsonic and supersonic speeds and thereby led to an increase of range.

Whilst as indicated above it is preferred that the extension rod be retained in a floating condition with respect to the fuse body under certain circumstances the extension rod can be formed integrally with the fuse body. With such an arrangement the disadvantage exists that the extension rod is only effective as a proximity fuse when impacting a relatively hard surface seeing that with a soft surface such as sand or water the extension rod becomes embedded before detonation takes place.

Figure 6:
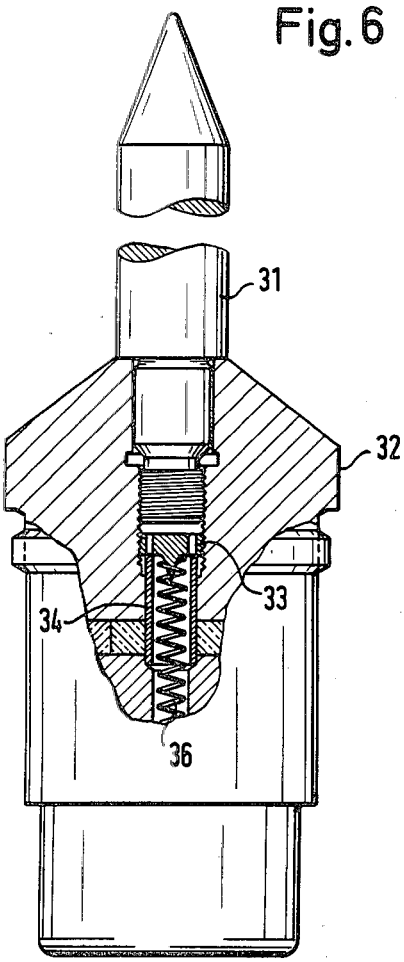
FIG. 6 is a partially sectioned side elevation of a modified fuse assembly in accordance with the invention prior to firing.
Figure 7:
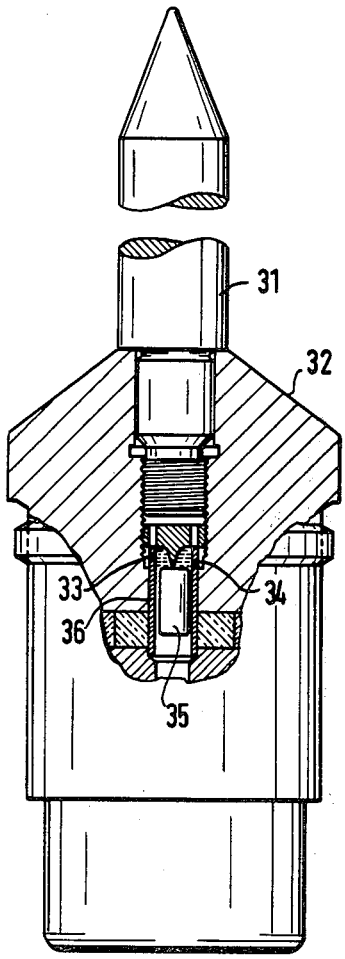
FIG. 7 is a view of the assembly shown in FIG. 6 at the moment of impact.

Such an arrangement is shown in FIGS. 6 and 7 of the drawings. In this arrangement an extension rod 31 which is dimensioned on the basis of the considerations outlined above is formed integrally with a fuse body 32 into which it projects and to which is rigidly secured in an axial position a firing stab 33. Slidable in an axial cavity 34 in the fuse body is a detonator 35 which is biased away from the firing stab 33 by means of a compression spring 36. During firing the detonator 35 moves to the end of the fuse body remote from the firing stab under the combined influences of the compression spring and the inertial forces. Upon impact of the extension rod 31 on a hard target the decelleration of the shell striking the target results in the detonator 35 being thrown on to the firing stab 33 against the biasing effect of the compression spring 36.

In a still further modification of the embodiment wherein the extension rod is formed rigidly with the fuse body the tip of the extension rod incorporates a piezo electric crystal whilst the tubular extension rod accommodates a conductor the rod itself constituting a second conductor the two conductors being electrically coupled to an electric detonating mechanism located in the fuse. Thus directly upon impact the piezo electric crystal generates a current which passes through these conductors to the electrical detonating mechanism initiating the detonation train. With this arrangement detonation cannot take place as a result of accidental impact with the tip of the extension rod seeing that under those circumstances the detonator is unarmed, mechanically by not being aligned with the striker and electrically by being short circuited.

Whilst in the specific example above the application of the invention to fin stabilized shells has been particularly considered the invention is equally applicable to all forms of projectiles wherein the detonation is desired at a predetermined distance from the target and wherein it is desired to ensure that the addition of the extension rod in accordance with the invention does not have any deleterious effect on the ballistic stability of the projectile.

We claim:

1. A fuze assembly adapted to be attached to the nose of a spin-stabilized projectile comprising:

a. a fuze body having an axial aperture with which a detonator is adapted to be aligned when the fuze assembly is armed;

b. an extension rod aligned with the aperture and projecting axially forwardly from the body and having a base by which the rod is mounted on the body for limited axial movement;

c. striker pin means slidably mounted in the body aperture, and having a maximum cross-section smaller than the maximum cross-section of the base; and d. spring means acting on the striker pin means for resiliently urging the latter in the forward direction into direct engagement with the base of the rod whereby an axial impulse in the rearward direction applied to the extension rod is transmitted by the base to the striker pin means causing the latter to move rearwardly independently of the rod and into engagement with the detonator when the firing assembly is armed.

2. A fuze assembly according to claim 1 wherein the striker pin means comprises an impulse transmission pin and a separate striker pin, the transmission pin being interposed between the extension rod and the striker pin, and the spring means urging the striker pin, the transmission pin and the base of the rod into direct engagement.

3. A fuze assembly according to claim 2 wherein the length of the extension rod is of the same order of magnitude as the length of the projectile before the fuze assembly is attached.

4. A fuze assembly according to claim 2, wherein the extension rod is essentially tubular and the base is solid and is provided with means for releasably attaching the rod to the body.

5. A fuze assembly according to claim 4 wherein the means for releasably attaching the rod to the body includes means defining a circumferential groove in the base and a connection pin removably mounted in the body, the connection pin being smaller than the groove and projecting thereinto for effecting the limited axial displacement of the rod.

6. A fuze assembly according to claim 4 wherein the base of the rod has a central conical recess and the body includes a fixed central boss matching the recess, the transmission pin being slidably mounted in an axial bore in the boss.

* * * * *